US006741037B2

(12) United States Patent
Lee

(10) Patent No.: US 6,741,037 B2
(45) Date of Patent: May 25, 2004

(54) DRIVING CIRCUIT OF DISPLAY FOR PREVENTING ELECTROSTATIC DISCHARGE

(75) Inventor: Hsin-Hung Lee, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/065,184

(22) Filed: Sep. 24, 2002

(65) Prior Publication Data

US 2004/0017159 A1 Jan. 29, 2004

(30) Foreign Application Priority Data

Jul. 25, 2002 (TW) ..... 91116536 A

(51) Int. Cl.[7] ..... G09G 3/10; G09G 3/32

(52) U.S. Cl. ..... 315/169.1; 315/169.3; 315/169.2; 345/82

(58) Field of Search ..... 315/169.1, 169.2, 315/169.3; 313/500, 503, 504; 345/76, 84, 85, 82, 91, 92; 326/81, 82, 68; G09G 3/10, 3/32

(56) References Cited

U.S. PATENT DOCUMENTS

| | | | | | |
|---|---|---|---|---|---|
| 4,899,086 | A | * | 2/1990 | Hirata et al. | 315/169.3 |
| 5,177,405 | A | * | 1/1993 | Kusuda et al. | 315/169.1 |
| 5,497,146 | A | * | 3/1996 | Hebiguchi | 340/14.63 |
| 6,266,036 | B1 | * | 7/2001 | Ohno | 345/82 |
| 6,493,047 | B2 | * | 12/2002 | Ha | 349/40 |

* cited by examiner

*Primary Examiner*—Don Wong
*Assistant Examiner*—Trinh Vo Dinh
(74) *Attorney, Agent, or Firm*—J. C. Patents

(57) ABSTRACT

A driving circuit of a display for preventing electrostatic discharge is provided. In the display, the anode of a light-emitting device in every pair of neighboring pixels is connected through a high resistant resistor (the resistance of the resistor depends on the material constituting the light-emitting device and size of the pixel). Any static electric charges produced during fabrication are even distributed to all the pixels and hence charges no longer accumulate at the anode of the light-emitting device leading to point defects in the display.

4 Claims, 2 Drawing Sheets

DRIVING CIRCUIT OF DISPLAY FOR PREVENTING ELECTROSTATIC DISCHARGE

CROSS REFERENCE TO RELATED APPLICATIONS

This application claims the priority benefit of Taiwan application serial no. 91116536, filed Jul. 25, 2002.

BACKGROUND OF INVENTION

1. Field of Invention

The present invention relates to the driving circuit of a display. More particularly, the present invention relates to the driving circuit of a display for preventing electrostatic discharge.

2. Description of Related Art

People are always interested in watching recorded images and movies. Ever since the invention of the cathode ray tube (CRT), television has become commercialized and television sets are owned by almost every family. With rapid progress in manufacturing techniques, the CRT has been used in many applications including the desktop monitor of a personal computer. However, due to radiation hazards and bulkiness of the electron gun, CRT display is heavy and hard to streamline into a flat panel.

Because of intrinsic bulkiness, researchers are now developing more slim-line displays. The so-called "flat panel displays" now includes liquid crystal displays (LCDs), field emission displays (FEDs), organic light-emitting diode (OLED) displays and plasma display panel (PDP) displays.

The organic light-emitting diode (OLED) is also known as an organic electroluminescence display (OELD) due to its self-illuminating character. OLED is driven by a low DC voltage and has properties including high brightness level, high energy efficiency, high contrast values as well as slimness and being lightweight. Moreover, the display is able to emit light of a range of colors from the three primary colors red (R), green (G) and blue (B) to white light. Hence, OLED is considered to be the display panel of the next generation. Aside from having high resolution and light just like the LCD and having self-illuminating capacity, a quick response and a low energy consumption just like the LED, OLED also has other advantages including a wide viewing angle, good color contrast and a low production cost. Thus, OLED is often used in LCD or as a background light source for indicator panels, mobile phones, digital cameras and personal digital assistants (PDA).

According to the type of driver selected to drive the OLED, the OLED can be divided into passive matrix driven or active matrix driven type. Passive matrix OLED has the advantage of structural simplicity and a low production cost. However, the passive matrix OLED has a relative low resolution rendering it unsuitable for producing high-quality images. Moreover, the passive matrix OLED consumes a lot of power, has a shorter working life and sub-optimal displaying capacity. Although the active matrix OLED is slightly more expensive to produce, it can be assembled to form a huge screen, aside from having a large viewing angle, the capacity for producing high brightness level and a quick response.

According to the driving method, a flat display panel is also divided into a voltage-driven type or a current-driven type. The pixel circuit of a conventional voltage-driven type of active matrix OLED is shown in FIG. 1. As shown in FIG. 1, the pixel circuit 10 includes a driving circuit 102 and an OLED (104). The driving circuit 102 further includes a thin film transistor TFT1 (106), a storage capacitor C (108) and a second thin film transistor TFT2 (110). The drain terminal of the transistor TFT1 (106) is coupled to a data line. The gate terminal of the transistor TFT1 (106) is coupled to a scanning line. The drain terminal of the transistor TFT1 (106) is coupled to a first terminal of the capacitor C (108) and the gate terminal of the transistor TFT2 (110). The second terminal of the capacitor C (108) is connected to a voltage source $V_{ss}$ (a common negative source line of the panel). The voltage source $V_{ss}$ is at a negative voltage or a ground potential. The drain terminal of the transistor TFT2 (110) is connected to another voltage source $V_{dd}$ (a common positive voltage line of the panel). The voltage source $V_{dd}$ is at a positive voltage. The source terminal of the transistor TFT2 (110) is coupled to the second terminal of the capacitor C (108) and the anode (also known as indium-tin-oxide, ITO) of the OLED (104). The cathode of the OLED (104) is coupled to the voltage source $V_{ss}$. With this type of design, the anode of the OLED in each pixel is separate and independent. Hence, each pixel 10 is linked to other pixels through the common voltage source $V_{dd}$ only when the transistor TFT2 (110) conducts. Because of this, static charges produced during the fabrication process are concentrated within individual pixels rather than distributing evenly to all pixels. Consequently, electrostatic discharge (ESD) of individual pixels may subsequently occur and damage the pixels. Ultimately, these pixels may fail to light up creating the so-called defect points. In general, tens and sometimes of point defects are found within an area 50 $cm^2$ of a display panel. When a large number of point defects appear on a display panel, quality of the image produced by the display will be greatly compromised.

SUMMARY OF INVENTION

Accordingly, one object of the present invention is to provide a driving circuit for a display that can prevent electrostatic discharge. By connecting the anodes of light-emitting device in every pair of neighboring pixels with a high resistant resistor (the value of the resistance depends on material constituting the light-emitting diode and size of each pixel), electric charge produced during fabrication is distributed evenly to all the pixels. Since electric charges no longer accumulate at the anode of the light-emitting device, point defects in the display is greatly reduced.

To achieve these and other advantages and in accordance with the purpose of the invention, as embodied and broadly described herein, the invention provides a driving circuit of a display for preventing electrostatic discharge. The driving circuit drives a first light-emitting device and a second light-emitting device. The first light-emitting device has an anode and a cathode. Similarly, the second light-emitting device has an anode and a cathode. A major aspect of this invention is the connection of the anode of the first light-emitting device with the anode of the second light-emitting device through a high resistant resistor. The resistance of the resistor must be greater than the internal resistance of the first light-emitting device and the internal resistance of the second light-emitting device.

In one preferred embodiment of this invention, the display is an active matrix organic electroluminescence display.

In another preferred embodiment of this invention, the first light-emitting device and the second light-emitting device are organic light-emitting diodes or polymeric light-emitting diodes.

This invention also provides a display capable of preventing electrostatic discharge. The display includes a plurality of pixels with each pixel having a light-emitting device. One major aspect of the display is that the each pair of neighboring anodes of the light-emitting device is connected together through a high resistant resistor. The resistance of the resistor must be greater than the internal resistance of the light-emitting diode.

In brief, the anode of each pair of neighboring pixels in a display is connected together through a high resistant resistor (the resistance of the resistor depends on the material constituting the light-emitting device and size of the pixel) in this invention. Hence, any static electric charges produced during fabrication are evenly distributed to all the pixels. Ultimately, electric charges no longer accumulate at the anode of the light-emitting device, thereby reducing overall number of point defects in the display.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
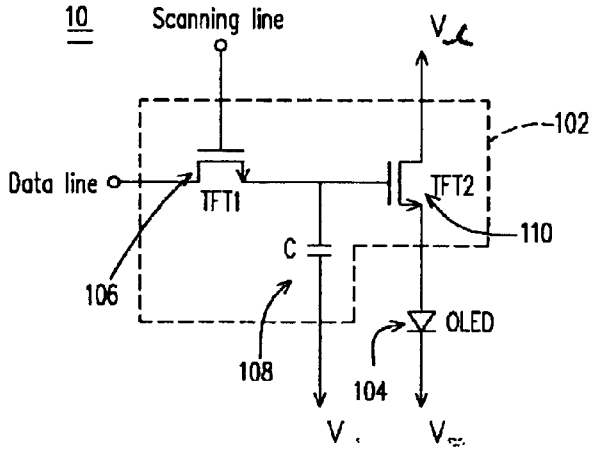
FIG. 1 (PRIOR ART)
FIG. 1 is a diagram showing the circuit of a pixel in a conventional display.

Reference will now be made in detail to the present preferred embodiments of the invention, examples of which are illustrated in the accompanying drawings. Wherever possible, the same reference numbers are used in the drawings and the description to refer to the same or like parts.

Figure 2:
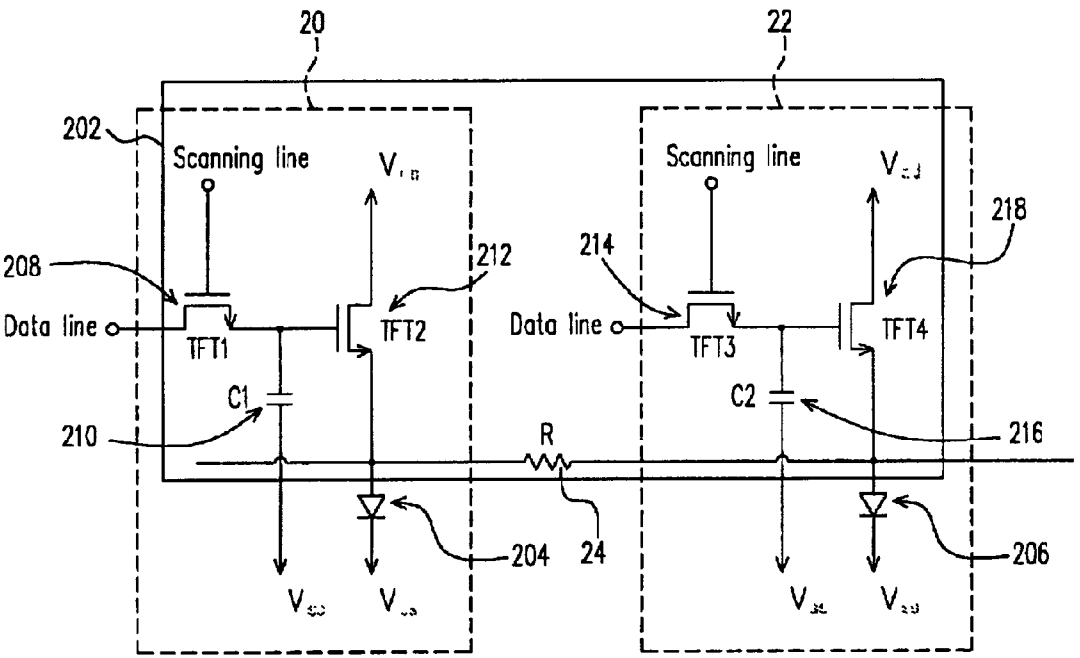
FIG. 2 is a diagram showing the circuit of a pair of neighboring pixels in a display capable of preventing electrostatic discharge according to one preferred embodiment of this invention.

FIG. 2 is a diagram showing the circuit of a pair of neighboring pixels in a display capable of preventing electrostatic discharge according to one preferred embodiment of this invention. The two neighboring pixels in the display include a first pixel 20, a second pixel 22 and a high resistant resistor R (24). The pixel 20 includes a light-emitting device 204 while the pixel 22 includes another light-emitting device 206. As shown in FIG. 2, one major aspect of the display is the connection of the anode of the light-emitting device between the pair of neighboring pixels 20 and 22 through the high resistant resistor R (24). The resistance of the resistor R (24) must be greater than the internal resistance of the light-emitting device.

From another viewpoint, the two neighboring pixels together constitute a unit inside the display that includes a driving circuit 202, a first light-emitting device 204 and a second light-emitting device 206 for preventing electrostatic discharge. The driving circuit 202 drives both light-emitting devices 204 and 206. The light-emitting device 204 has an anode and a cathode. Similarly, the light-emitting device 206 has an anode and a cathode. The light-emitting devices 204 and 206 can be organic emitting diodes or polymeric light-emitting diodes. The driving circuit 202 includes a first transistor TFT1 (208), a first storage capacitor C1 (210), a second transistor TFT2 (212), a third transistor TFT3 (214), a second storage capacitor C2 (216), a fourth transistor TFT4 (218) and a high resistant resistor R (24). Note that the anode and the cathode of a passive organic electroluminescence display are aligned in a row or a column, and electric charges are distributed across the entire row or column and hence there is no charge accumulation problem. Thus, the design according to this invention mainly applies to an active organic electroluminescence display. The following is a more detailed description of the structural connections within the driving circuit 202.

The first transistor TFT1 (208) has a drain terminal, a gate terminal and a source terminal. The storage capacitor C1 (210) has two terminals. The second transistor TFT2 (212) has a drain terminal, a gate terminal and a source terminal. The third transistor has a drain terminal, a gate terminal and a source terminal. The storage capacitor C2 (216) has two terminals. The fourth transistor TFT4 (218) has a drain terminal, a gate terminal and a source terminal. The high resistant resistor R (24) also has two terminals. The drain terminal of the first transistor TFT1 (208) is coupled to a data line. The gate terminal of the first transistor TFT1 (208) is coupled to a scanning line. The source terminal of the first transistor TFT1 (208) is coupled to one terminal of the capacitor C1 (210) and the gate terminal of the second transistor TFT2 (212). The other terminal of the capacitor C1 (210) is coupled to a voltage source $V_{ss}$ (the common negative voltage line of the panel). The voltage source $V_{ss}$ is at a negative voltage or a ground potential provided by a power supplier. The drain terminal of the second transistor TFT2 (212) is coupled to another voltage source $V_{dd}$ (the common positive voltage line of the panel). The voltage source $V_{dd}$ is a positive voltage provided by the power supplier. The source terminal of the second transistor TFT2 (212) is coupled to one end of the high resistant resistor R (24) and the anode of the light-emitting device (204). The drain terminal of the third transistor TFT3 (214) is coupled to the data line. The gate terminal of the third transistor TFT3 (214) is coupled to the scanning line. The source terminal of the third transistor TFT3 (214) is coupled to one terminal of the capacitor C2 (216) and the gate terminal of the fourth transistor TFT4 (218). The other terminal of the capacitor C2 (216) is coupled to the voltage source $V_{ss}$. The drain terminal of the fourth transistor TFT4 (218) is coupled to the voltage source $V_{dd}$. The source terminal of the fourth transistor TFT4 (218) is coupled to the other terminal of the high resistant resistor R (214) and the anode of the light-emitting device (206). The cathode of the light-emitting device (204) and the cathode of the light-emitting device (206) are coupled to the voltage source $V_{ss}$. The high resistant resistor R (24) must have a resistance greater than the internal resistance of the light-emitting device 204 and the internal resistance of the light-emitting device 206.

Note that one major aspect of this invention is the insertion of a high resistant resistor between the anodes of neighboring pixels in a display so that charges accumulated in any particular pixel are distributed evenly to all other pixels. Therefore, damage to single pixels due to electrostatic discharge and hence point defects in the display are minimized. Furthermore, when the anode of the light-emitting device between neighboring pixels in a display is connected through a high resistant resistor, the resistance of the high resistant resistor must have a value greater than the internal resistance of the light-emitting device so as to avoid mutual interference between neighboring pixels. In general, the resistance of the high resistant resistor ranges between 0.1K to 100M depending on material constituting the light-emitting device and size of the pixel.

In summary, this invention provides a connection between the anodes of each pair of neighboring pixels in a display through a high resistant resistor (the resistance of the resistor depends on the material constituting the light-emitting device and size of the pixel). Hence, any static electric charges produced during fabrication are evenly distributed to all the pixels. Ultimately, electric charges no longer accumulate at the anode of the light-emitting device, thereby reducing overall number of point defects in the display.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display having a plurality of pixels therein for preventing electrostatic discharge, wherein each pixel has a light-emitting device, one major characteristic of the display includes:

a high resistant resistor connecting the anodes of the light-emitting devices in every pair of neighboring pixels, wherein the resistance of the high resistant resistor is greater than the internal resistances of the light-emitting devices.

2. The display of claim 1, wherein the display is an active matrix organic electroluminescence display.

3. The display of claim 1, wherein the light-emitting device is an organic light-emitting diode.

4. The display of claim 1, wherein the light-omitting device is a polymeric light-emitting diode.

* * * * *